US005539165A

United States Patent [19]

Wu

[11] Patent Number: 5,539,165

[45] Date of Patent: Jul. 23, 1996

[54] ELECTRIC LOCK FOR CHILDREN'S AUTOMOBILES

[76] Inventor: John Wu, No. 20, Da Yu 1th St., Da Liao Hsiang, Kaohsiung Hsien, Taiwan

[21] Appl. No.: 334,023

[22] Filed: Nov. 2, 1994

[51] Int. Cl.[6] ..... H01H 27/06

[52] U.S. Cl. ..... 200/43.08; 200/43.04; 200/43.110; 70/DIG. 30

[58] Field of Search ..... 200/43.01, 43.04, 200/43.06, 43.08, 564, 565, 567, 570, 571, 43.11; 70/DIG. 30

[56] References Cited

U.S. PATENT DOCUMENTS

| | | | |
|---|---|---|---|
| 3,270,151 | 8/1966 | Godette | 200/43.08 |
| 4,639,562 | 1/1987 | Fredrickson | 200/43.08 |
| 4,855,541 | 8/1989 | Yamashita et al. | 200/565 |

*Primary Examiner*—David J. Walczak
*Attorney, Agent, or Firm*—Alfred Lei

[57] ABSTRACT

An electric lock for children's automobiles including a base having a corrugated annular member engaged with three terminals, a cover engaged with a top of the base and formed with a first keyhole, a spring mounted under the cover, a driving disk mounted under the spring and having a second keyhole aligned with the first keyhole of the cover, a cylindrical portion at a bottom thereof, and two pins downwardly depending from the cylindrical portion, and a conducting plate arranged under the driving disk and having a third keyhole aligned with second keyhole of the driving disk, a first corrugated portion with a plurality of wavelike folds engaged with the corrugated annular member, and a second corrugated portion with a single wavelike fold engaged with the corrugated annular member, and a power connector for connecting with a power source and a controller.

1 Claim, 7 Drawing Sheets

ELECTRIC LOCK FOR CHILDREN'S AUTOMOBILES

BACKGROUND OF THE INVENTION

It has been found that the conventional electric lock for children's automobiles is mainly composed of a cover 1 and a body portion 2 (see FIG. 9). When in use, a key 3 is first inserted into the electric lock through the keyhole of the cover 1 and then rotated through an angle of 90 degrees so that the head of the key 3 presses down a switch 21 to turn on the power source for the motor of the children's automobile. However, such an electric lock has only one stage and so the usage thereof is very limited.

Therefore, it is an object of the present invention to provide an electric lock which can obviate and mitigate the above-mentioned drawbacks.

SUMMARY OF THE INVENTION

This invention relates to an improved electric lock for childern's automobiles.

It is the primary object of the present invention to provide an electric lock for childern's automobiles which is of a plurality of stages.

It is another object of the present invention to provide an electric lock for children's automobiles which is practical in use.

It is still another object of the present invention to provide an electric lock for children's automobiles which is simple in construction.

It is still another object of the present invention to provide an electric lock for childern's automobiles which is low in cost.

It is a further object of the present invention to provide an electric lock for childern's automobiles which is easy to manufacture and assemble.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
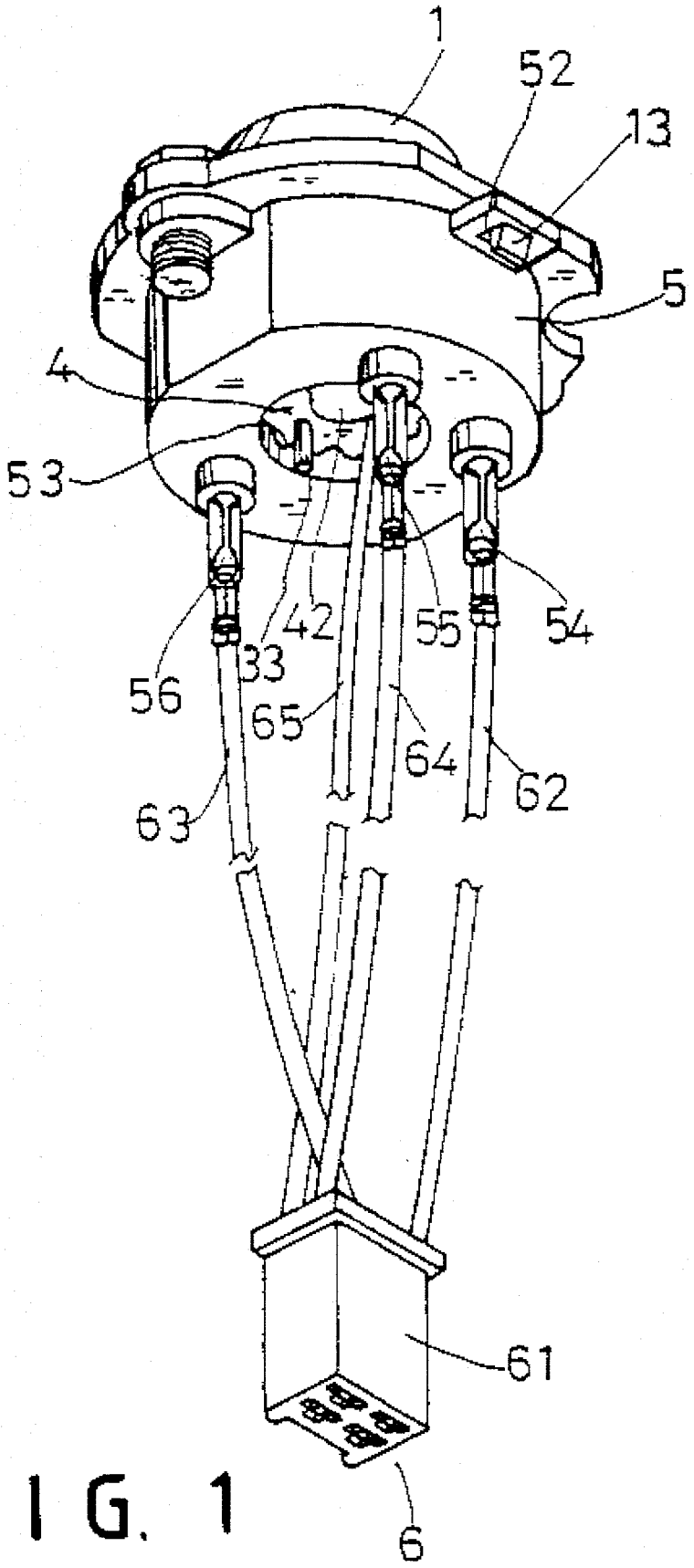
FIG. 1 is a perspective view of the present invention.

For the purpose of promoting an understanding of the principles of the invention, reference will now be made to embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
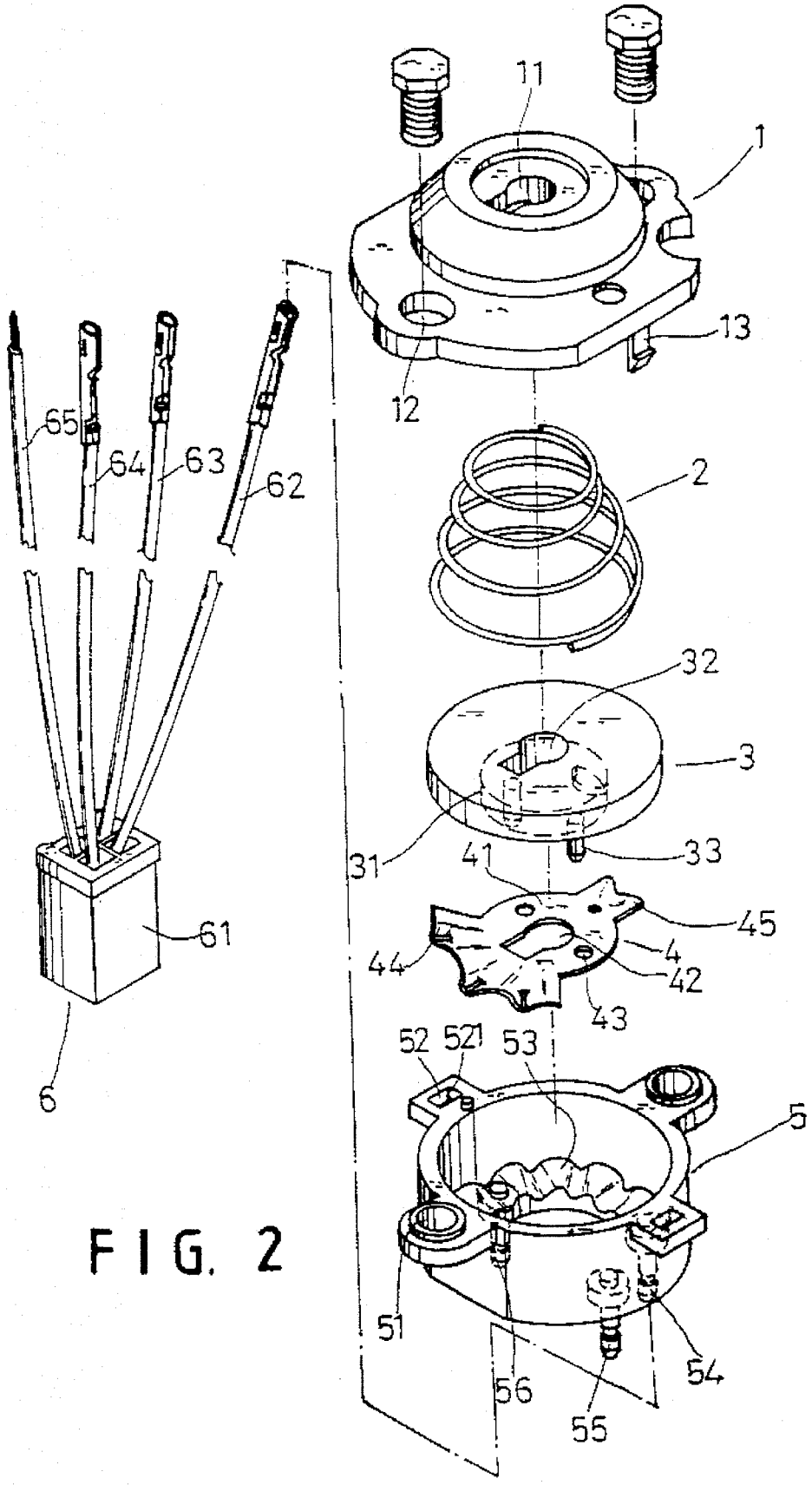
FIG. 2 is an exploded view of the present invention.
Figure 3:
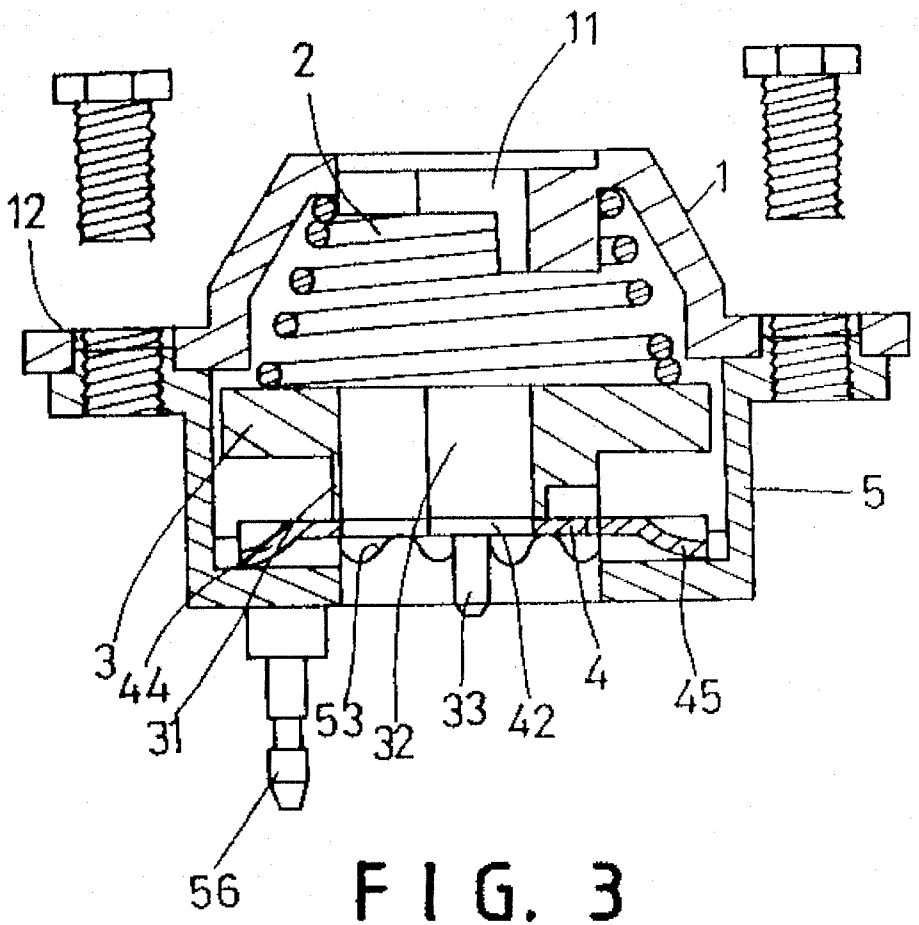
FIG. 3 is a sectional view of the present invention.
Figure 6:
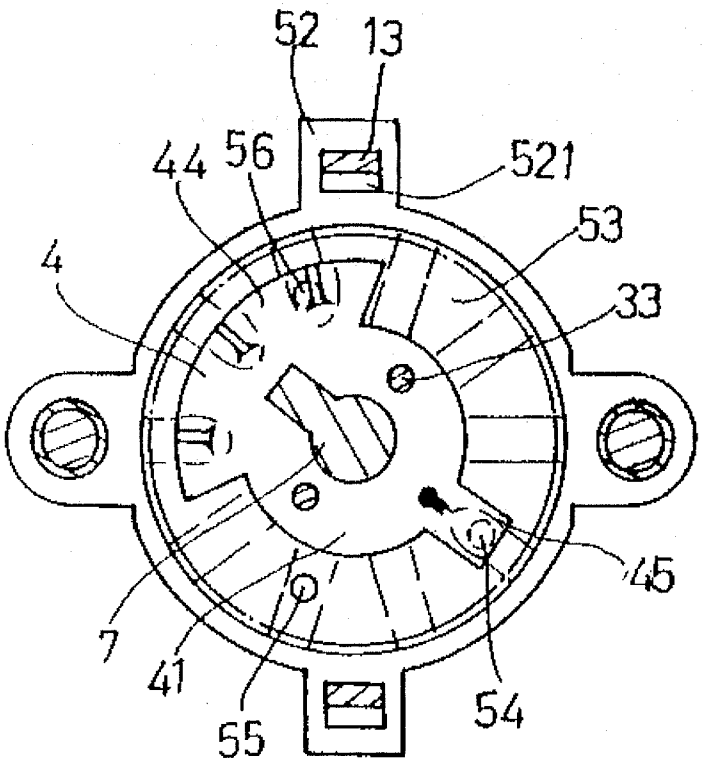
FIGS. 5, 6, 7 and 8 show the working principle of the present invention.

With reference to the drawings and in particular to FIGS. 1, 2 and 3 thereof, the electric lock according to the present invention mainly comprises a cover 1, a spring 2, a driving disk 3, a conducting plate 4, a base 5 and a power connector 6.

The cover 1 is formed with a keyhole 11 at the center, two holes 12 at two sides, and two hooks 13 downwardly depending from the bottom. The spring 2 is disposed under the cover 1. The driving disk 3 is mounted under the spring 2 and formed with a circular portion 31 at the bottom, a keyhole 32 at the center, and two pins 33 downwardly depending from the bottom.

The conducting plate 4 includes a body portion 41 formed at the center with a keyhole 42 aligned with the keyhole 11 of the cover 1 and the keyhole 32 of the driving disk 3, formed at two sides with two holes 43 adapted to receive the pins 33 of the driving disk 3, and formed at one side with a first corrugated portion 44 and at another side with a second corrugated portion 45. The first corrugated portion 44 is formed with a plurality of wavelike folds while the second corrugated portion 45 with a single wavelike fold.

The base 5 is a cylindrical member having two holes 51 aligned with the holes 12 of the cover 1, two lugs 52 each having a slot 521, an annular member 53 having a corrugated surface adapted to the first corrugated portion 44 and second corrugated portion 45 of the conducting plate 4. Three terminals 54, 55 and 56 are provided on the bottom of the annular member 53.

The power connector 6 includes a seat 61 connected with four electrical wires 62, 63, 64 and 65. The electrical wire 65 is soldered or otherwise secured to the second corrugated portion 45 of the conducting plate 4, while the electrical wires 62, 63 and 64 are connected with the three terminals 54, 56 and 55.

Figure 4:
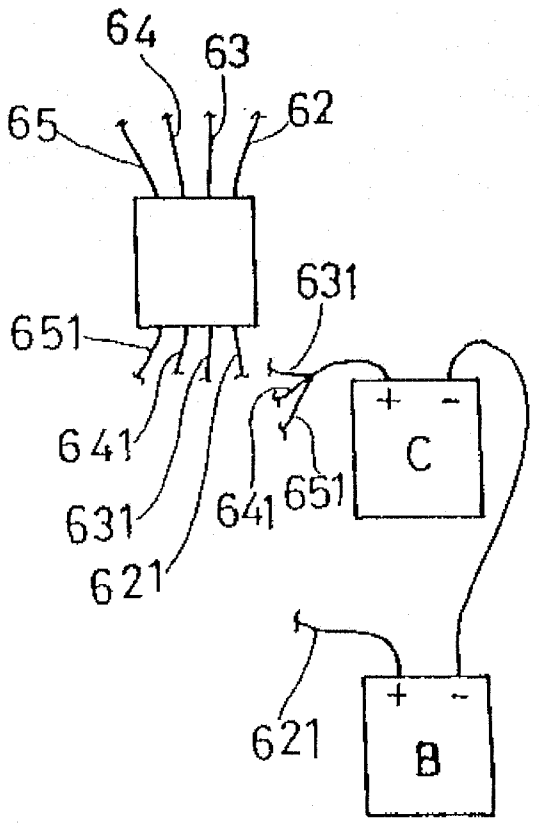
FIG. 4 shows the connection between the present invention and the battery and controller.

As shown in FIG. 4, the electrical wires 62, 63, 64 and 65 of the power connector 6 are respectively connected with electrical wires 621, 631, 641 and 651. The electrical wire 621 is connected with a positive terminal of a battery B, while the electrical wires 631, 641 and 651 are connected a positive terminal of a controller C.

Figure 5:
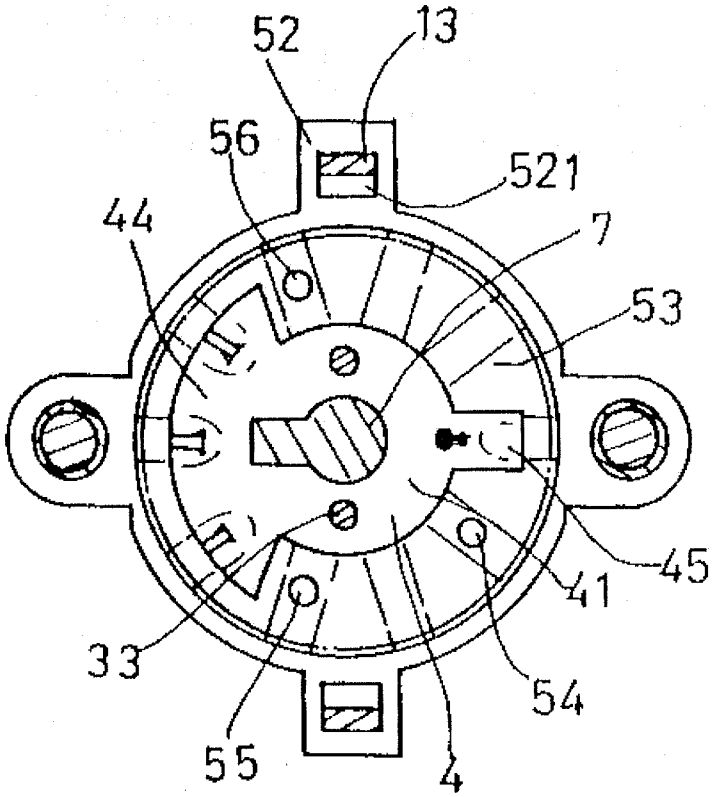
Figure 8:
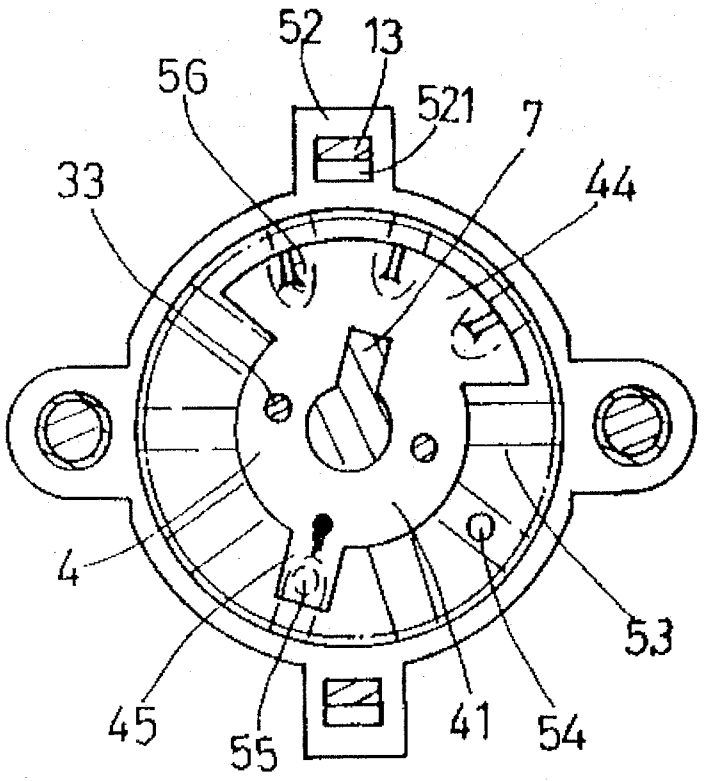
Figure 7:
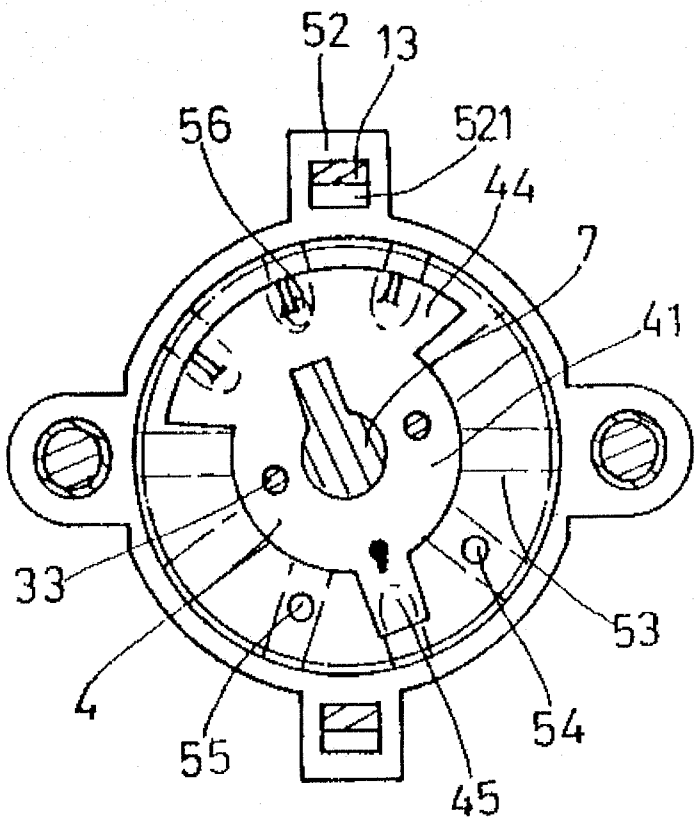
Figure 9:
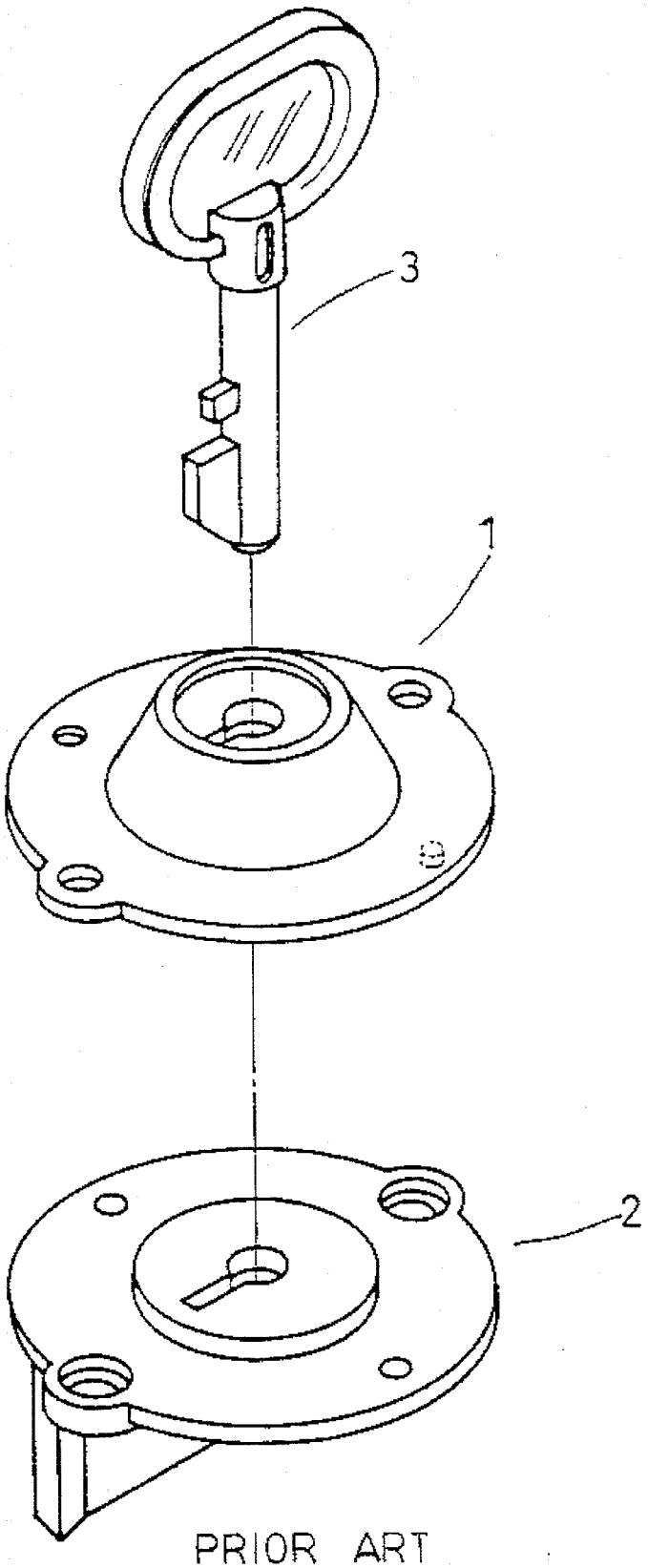
PRIOR ART FIG. 9
FIG. 9 shows a prior art electric lock.
Figure 10:
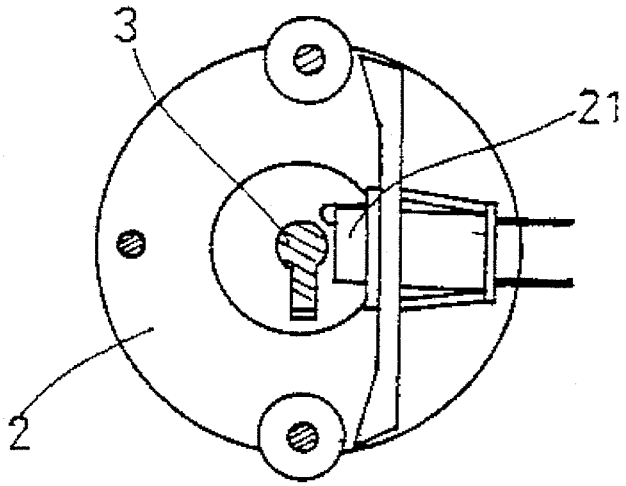
PRIOR ART FIG. 10
FIGS. 10 and 11 show the working principle of the prior art electric lock.
Figure 11:
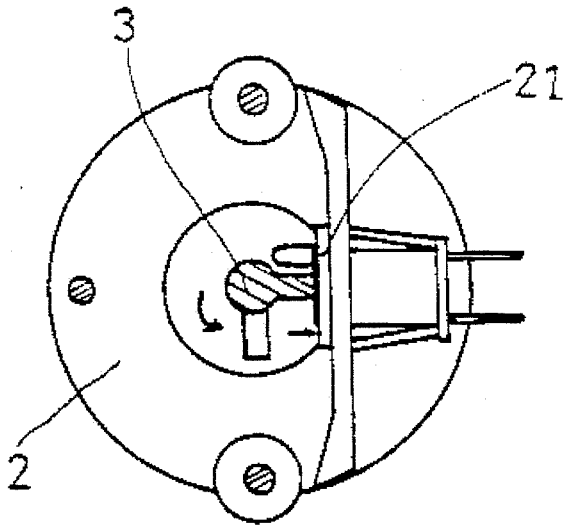
PRIOR ART FIG. 11

FIGS. 5, 6, 7 and 8 show the working principle of the present invention. As illustrated in FIG. 5, the corrugated portions 44 and 45 are not in contact with the terminals 54, 55 and 56 so that the power source is not turned on.

As the key 7 is inserted and turned, the driving disk 3 will be rotated thereby rotating the conducting plate 4 with respect to the annular member 53. As the first corrugated portion 44 of the conducting plate 4 is in contact with the terminal 56, the second corrugated portion 45 of the conducting plate 4 will be in contact with the terminal 54 at the same time (see FIG. 6). Hence, the motor of the toy automobile (not shown) and a music reproducing device or the like are turned on. When the key 7 is further turned, the conducting plate 4 will be rotated to a position where the first corrugated portion 44 of the conducting plate 4 is still in contact with the terminal 56, but the second corrugated portion 45 is separated from the terminal 54 so that the power source is turned on but the music reproducing device or the like is turned off (see FIG. 7). If the key 7 is further turned, the conducting plate 4 will be rotated to a position where the first corrugated portion 44 of the conducting plate 4 is still in contact with the terminal 56, but the second corrugated portion 45 of the conducting plate 4 is in contact with the terminal 55.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An electric ignition switch for children's automobiles comprising:

a base having a corrugated annular member and three terminals positioned on said corrugated annular member;

a cover engaged with a top of said base and formed with a first keyhole;

a spring mounted under said cover;

a driving disk mounted under said spring and having a second keyhole aligned with the first keyhole of said cover, a cylindrical portion at a bottom thereof, and two pins downwardly depending from the cylindrical portion; and a conducting plate engaged with said pins; said conducting plate arranged under said driving disk and having a third keyhole aligned with second keyhole of said driving disk, a first conductive corrugated portion with a plurality of wavelike folds engaged with the corrugated annular member and engagable with a selected number of said terminals and a second conductive corrugated portion with a single wavelike fold engaged with said corrugated annular member and engagable with a selected number of said terminals; and a power connector including a seat connected with four electrical wires, one of said electrical wires being connected with the second corrugated portion of said conducting plate while the other three of said electrical wires being respectfively connected with the three terminals of said base.

* * * * *